US006720025B2

(12) United States Patent
Yapel et al.

(10) Patent No.: US 6,720,025 B2
(45) Date of Patent: Apr. 13, 2004

(54) SLOT EXTRUSION COATING METHODS

(75) Inventors: Robert A. Yapel, Oakdale, MN (US); Wayne P. Ray, Weatherford, OK (US); David J. Scanlan, Ventura, CA (US); Larry A. Lien, Woodbury, MN (US); Charles W. Simpson, Lakeland, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 20 days.

(21) Appl. No.: 10/186,809

(22) Filed: Jul. 1, 2002

(65) Prior Publication Data

US 2004/0001912 A1 Jan. 1, 2004

(51) Int. Cl.[7] ..... B08D 1/26
(52) U.S. Cl. ..... 427/9; 427/356; 427/358
(58) Field of Search ..... 427/8, 9, 356, 427/358; 118/410

(56) References Cited

U.S. PATENT DOCUMENTS

| | | | | |
|---|---|---|---|---|
| 2,901,770 A | | 9/1959 | Beck | |
| 3,671,236 A | | 6/1972 | Van Beusekom | |
| 3,911,196 A | | 10/1975 | Navidad | |
| 4,113,903 A | | 9/1978 | Choinski | |
| 4,183,976 A | | 1/1980 | Yamada et al. | |
| 4,216,290 A | | 8/1980 | De Beul | |
| 4,666,817 A | | 5/1987 | Sachi | |
| 5,030,484 A | | 7/1991 | Chino et al. | |
| 5,072,688 A | | 12/1991 | Chino et al. | |
| 5,433,973 A | | 7/1995 | Wallack et al. | |
| 5,639,305 A | | 6/1997 | Brown et al. | |
| 5,643,992 A | | 7/1997 | Northey | |
| 5,728,430 A | | 3/1998 | Sartor et al. | |
| 5,741,549 A | | 4/1998 | Maier et al. | |
| 5,759,274 A | | 6/1998 | Maier et al. | |
| 5,962,075 A | * | 10/1999 | Sartor et al. | 427/356 |
| 6,511,711 B2 | * | 1/2003 | Quiel et al. | 427/458 |

FOREIGN PATENT DOCUMENTS

| | | |
|---|---|---|
| DE | 263 653 A3 | 11/1989 |
| EP | 0 273 585 B1 | 7/1988 |
| EP | 0 462 704 A1 | 12/1991 |
| GB | 1 375 295 | 11/1974 |
| GB | 1 497 224 | 1/1978 |
| GB | 2 057 471 A | 4/1981 |
| WO | WO 95/29763 | 11/1995 |
| WO | WO 95/29764 | 11/1995 |
| WO | WO 95/29765 | 11/1995 |
| WO | WO 96/38511 | 12/1996 |

OTHER PUBLICATIONS

*AIChE Journal*, Carvalho, Marcio S. et al., Oct. 2000, "Low–Flow Limit in Slot–Coating: Theory and Experiment", pp. 1907–1917.

(List continued on next page.)

*Primary Examiner*—Katherine A. Bareford
(74) *Attorney, Agent, or Firm*—Brian E. Szymanski

(57) ABSTRACT

A method of slot extrusion coating is provided that can be used to apply thin coatings using liquid compositions having high percent solids. A window of operability advantageously identifies the limits of a process to provide these thin high solids coatings. The window of operability is determined by obtaining a first graphical curve representing actual values of wet thickness as a function of percent solids level. The critical wet thickness is then identified on the first graphical curve. The window of operability is identified as an area defined by the boundaries: percent solids greater than the point at which critical wet thickness occurs, an actual wet thickness greater than all points above the first graphical curve and equal to or less than the critical thickness.

17 Claims, 7 Drawing Sheets

OTHER PUBLICATIONS

*Chemical Engineering Science*, vol. 31, 1976, Rushak, K. J., "Limiting Flow in A Pre–Metered Coating Device", pp. 1057–1060.

*Chemical Engineering Science*, vol. 35, 1980, Higgins, B.G. and Scriven, L.E., "Capillary Pressure and Viscous Pressure Drop Set Bounds on Coating Bead Operability", pp. 673–682.

*Coating and Drying Defects: Troubleshooting Operating Problems*, by Edgar Gutoff, Edward Cohen, Gerald Kheboian, 1995, SPE, A Wiley–Interscience Publication, John Wiley & Sons, p. 7.

*International Society of Coating Science and Technologies* (*ISCST*), $10^{th}$ International Coating Science and Technology Symposium, Sep. 25–27, 2000, "Coating Rheology: An Assessment", Prasannarao Dontula, Matteo Pasquali, Christopher W. Macosko, and L.E. Scriven, pp. 174–177.

*International Society of Coating Science and Technology* (*ISCST*), $9^{th}$ International Coating Science and Technology Symposium, May 17–21, 1998, "Minimum Film Thickness in Slot Coating At High Capillary Numbers", Marcio S. Carvalho, pp. 47–50.

*Liquid Film Coating*, Stephan F. Kistler and Peter M. Schweizer, 1997, Chapman & Hall, p. 403.

*UMI Company*, Ann Arbor, MI, "Polymer Solutions In Coating Flows", A Thesis Submitted To The Faculty Of The Graduate School Of The University of Minnesota by Prasannarao Dontula, Jul. 1999, pp. ii, 14, 17, 18, 26, 30, 102–123, 149–152, 166, 167.

* cited by examiner

SLOT EXTRUSION COATING METHODS

FIELD OF THE INVENTION

This invention relates to coating, and more particularly to methods of slot extrusion coating by first determining a window of operability.

BACKGROUND

Coatings are generally applied as a uniform, continuous layer. Slot extrusion coating is just one way to coat a composition onto a substrate, as many other methods are available such as coating by curtain, knife or blade, forward-roll, reverse roll, or slide methods. Slot extrusion coating is particularly useful for applying coatings at high substrate speeds and for precision applications. Coating by slot extrusion can provide precise, premetered quantities of a composition. In general, slot extrusion coating is used to deliver thin sheets of material (e.g., coating) onto a substrate by feeding fluid to a coating die, which in turn, then applies the fluid to a substrate in the form of a sheet or film. A coating bead is often used to refer to the bridge of liquid spanning the gap between a die and a substrate.

Many studies have been performed to understand or model the dynamics and other behavioral effects liquid compositions have during coating operations. For example, rheology, shear thinning, viscosity, elasticity, Newtonian or non-Newtonian flow, inertial effects and extensional effects, to name just a few, have been subjects of coating studies. Of particular interest in studying these effects and characteristics is the manageability and optimization of coating methods to achieve coatings less susceptible to drying defects. The coatability of a composition in combination with a particular coating technique is an area of interest, especially for operations that desire thin coatings, use high solids content, or both.

Typically, in premetered coating techniques, the flow rate per unit width of a substrate, in combination with the substrate speed, can determine the thickness of a coating layer or sheet. Advantageously, the premetered coating technique of slot extrusion coating can provide a high precision coating of thin layer by merely prescribing the flow rate of the liquid as it is fed into a coating die, and may be independent of other process variables. Conventional methods prescribed that higher line speeds would require thicker wet layers. Thus, to attain thinner coatings, one skilled in the art generally decreases the flow rate and substrate speed. The ability to decrease flow rate, however, is generally limited by the Theological properties of the coating composition itself. Decreasing a flow rate too low can result in the non-uniform or unstable sheets. Further, reduction in substrate speed is generally undesirable because of resulting reduction in manufacturing productivity.

It is also recognized in slot extrusion that lowering the viscosity of the coating composition is another method used by those skilled in the art to reduce the thickness of the resulting coating. This is accomplished by adjusting the composition or reducing the percent solids of the coating liquid. Lower viscosity layers are often susceptible to undesirable drying patterns, such as mottle or Benard cells, in the finished coating.

It has been attempted to control coating thickness by modifying the size of a coating gap located between a die and a substrate. That is, it was thought that thinner coatings can be achieved with tighter or smaller gaps. However, gaps under 100 microns, for example, can result in operating difficulties, as particulate matter can accumulate in the coating gap and subsequently create defects such as streaks.

The coatability of a composition in combination with a particular coating technique is an area of interest, especially for operations that desire thin coatings, use high solids content, or both. What is desired is a method of slot extrusion coating a substrate using a composition having a high solids content, that can be applied at a reasonable, production-worthy substrate speed to provide high quality coatings. Methods that can provide thin sheets of coating at acceptable substrate speeds would also be desirable.

SUMMARY

A method of slot extrusion coating is provided that can be used to apply thin coatings using liquid compositions having high percent solids. A window of operability advantageously identifies the limits of a process to provide these thin high solids coatings.

In a preferred aspect, a method for slot extrusion coating is provided, where the method includes:

- providing a liquid composition having at least one polymer and a diluent, where the composition is substantially free of crosslinking and gellation and has a measurable percent solids;
- operating a slot extrusion coater wherein said liquid composition is extruded from said slot extrusion coater;
- determining actual values of minimum wet thickness, $T_{w,min}$ at more than one level of percent solids;
- obtaining a first graphical curve representing actual values of wet thickness, $T_{w,min}$ as a function of percent solids level;
- identifying the critical wet thickness, $T_{w,min\text{-}critical}$ on the first graphical curve; and
- identifying a window of operability as an area defined by the boundaries: percent solids greater than the point at which critical wet thickness, $T_{w,min\text{-}critical}$ occurs; and an actual wet thickness greater than all points above the first graphical curve and equal to or less than the critical thickness, $T_{w,min\text{-}critical}$ In another aspect of the invention, the method further includes steps of:

- defining a target dry coating weight, $W_D$;
- calculating a plurality of values for $T_{w,calc}$ (in meters) using formula (I), each $T_{w,calc}$ value corresponding to a percent solids level, wherein formula (I) is $$T_{w,calc}=(100*W_D)/(\%S*\rho_L) \quad \text{(I)}$$

wherein $W_D$ is the dry coating weight (kg/m$^2$), %S is the percent solids, and ρ is coating liquid density (kg/m$^3$);

- obtaining a second graphical curve representing calculated values of wet thickness, $T_{w,calc}$ as a function of percent solids level; and
- identifying the window of operability as the area defined by the boundaries:

$T_{w,calc}$ greater than the first graphical curve and a percent solids level greater than the point at which $T_{w,min\ critical}$ occurs.

In a further aspect, a method of the invention includes additional steps of adjusting the liquid composition to have a percent solids within the window of operability; and coating a substrate with the liquid composition at a $T_w$ that falls within the window of operability.

In yet another aspect of the invention, a coated substrate using a method of the invention is provided, where a coating made in accordance with the invention is substantially free of coating instabilities.

As used herein and in the claims, the following terms have the meanings as now set forth:

a "bead" or a "sheet" is descriptive of the liquid coating that emerges from the coating die;

"operability window" or "window of operability" is the range of certain parameters in which a coating process can operate to provide and maintain a coating bead according to the present invention; and "conventional coating techniques" include the range of coating parameters that permit the application of a coating onto a substrate that are not within the operability window of the present invention and do not provide the advantageous effects of the present invention.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF THE PREFERRED EMBODIMENTS

Figure 1:
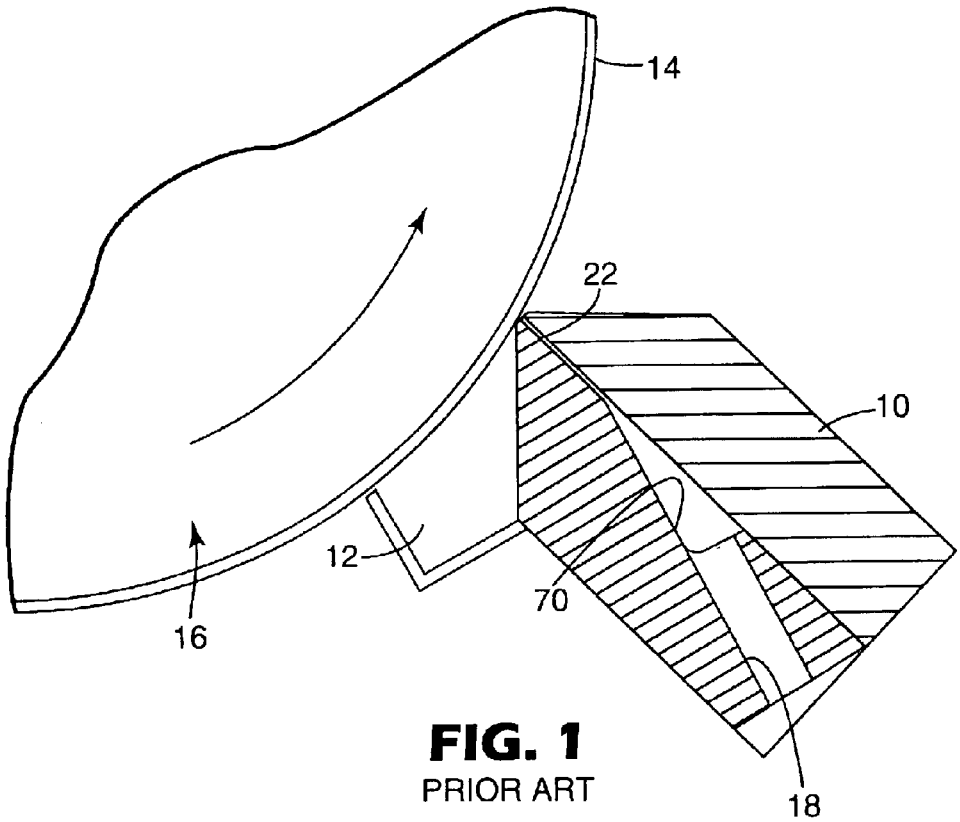
FIG. 1 PRIOR ART
FIG. 1 is a schematic of a slot extrusion coating apparatus.

The present invention provides a method of slot extrusion coating a substrate in an efficient manner by using higher percent solids. Advantageously preferred methods of the invention result in coatings having minimal coating instabilities yet can be provided in fairly thin coating thicknesses.

In an aspect of the invention, a method of operating a coating process is provided that advantageously identifies a broad window of operability. In the window of operability, a practitioner can be assured that a coating layer can be applied without resulting in coating defects or instabilities, since the limits or boundaries of the window are set by the occurrence of such instabilities. As used herein and in the claims, "instabilities" describes generally undesirable coating irregularities such as air entrainment often caused by imperfect wetting of the liquid composition on a substrate, rivulates that appear as alternating stripes of coated and uncoated areas, or other coating imperfections that include, but are not limited to ribbing, chatter, streaks, transverse waves, herringbone, bands, barring, bead breaks and weeping.

Preferred methods of the invention allows for the use of compositions that can comprise reduced amounts of solvent. This, in turn, allows coating operations to be conducted at higher substrate speeds and reduced drying times. Furthermore, by having reduced drying times, a coated substrate can be less susceptible to potential airborne contaminants that can cause defects in the coating layer. Preferred methods of the invention may improve the quality and uniformity of a hardened (e.g., dried) coating. Although not wishing to be bound by theory, the improved coating characteristics can be attributed to the combination of higher viscosity and lower wet thickness, especially to coatings that may be sensitive to drying defects, formation patterns, or both. For example, mottle and Benard cells are forms of defects that may be avoided through the use of the present invention.

As a further advantage, the methods of the invention can help achieve optimization with faster substrate speeds and larger coating gaps. Increased web speeds allow greater productivity of a coating operation. The capability of using larger coating gaps can result in less streaking from contaminants that might lodge in narrow coating gaps or potentially cause damage to a coating bar. In prior conventional methods, coating at certain high speeds could lead to air entrainment by forming air bubbles in the liquid or other coating failures due to sheet instability. Therefore conventional methods often suggest modifying the composition (e.g., diluting with solvents and other diluents). (See for example, Higgens and Scriven, Chem. Eng. Sci. 35:673–682, 1980). In the method of this invention, it has been surprisingly found that coatings can be slot extruded without requiring dilutions, thus having higher concentrations of solids while achieving acceptable thin coatings.

The present invention provides a method of slot extrusion coating, based on the identification of a new operating window. The operating window can assist a practitioner in setting optimal operating parameters to achieve thin polymeric coatings at greater percent solid concentrations.

In slot extrusion coating, it is preferable that the coating be extruded in a substantially uniform sheet or layer. The uniform sheet or layer is generally obtained by applying a steady flow of liquid. Liquid can be pumped into a coater and then extruded out from a feed slot, where a slot is often defined by a die made up of a set of upstream and downstream lips. A two-dimensional application is achieved by applying the premetered coating composition onto a moving substrate or web. FIG. 1 provides a schematic of a standard slot extrusion coating apparatus. The die 10 has a vacuum chamber 12 as a part of a metered coating system. A coating liquid is supplied by a pump (not shown) to the die for application onto a moving web 14. The web 14 is supported by roller 16. Coating liquid is supplied through a channel 18 to a manifold 20 for distribution through a slot 22 in the die 10. The coating liquid flows through the slot 22 as a continuous coating bead onto the web 14.

A coating operation that can be used in accordance with the present invention can be any of the generally known slot extrusion coaters useful for providing a laminar bead of fluid onto a moving web or substrate. Coating apparatuses such as those disclosed in patent applications WO 95/29764, WO 95/29763, U.S. Pat. Nos. 5,759,274, and 5,639,305 can be used in the practice of the invention. Other suitable slot extrusion coaters are described in "Coating and Drying Defects Troubleshooting Operating Problems," by Edgar Gutoff, Edward Cohen, Gerald Kheboian, 1995.

A slot extrusion coating process is preferably operated at a substrate speed sufficient to allow an economically productive manufacturing rate and provide a stable coating without instabilities. In the practice of the invention, a slot extrusion coating process can be operated at a line or substrate speed of less than about 10 m/sec. More preferably, the substrate speed is less than about 5 m/sec. The substrate speed may be greater than about 0.127 m/sec. Other operating parameters of a coater can be set and adjusted as needed, such as, for example, the liquid flow rate, the coating gap, feed slot width, overbite, convergence, and vacuum gap. Preferably, the speed is maintained at a rate that minimizes liquid leakage (such as what can occur at low substrate speed) or air entrainment (such as what can occur at high substrate speed).

A "low-flow limit" as described in "Low-Flow Limit in Slot-Coating: Theory and Experiment," Carvalho, Marcio S. et al, AlChE Journal, October 2000, pp 1907–1917, corresponds to the maximum line substrate speed possible at a given film thickness, or the minimum attainable wet film thickness at a given line speed having a stable flow of liquid. It has been found that the use of minimum attainable wet thickness is useful in identifying an unexpectedly broad window of operability. Thus, actual values of "minimum wet thickness" is preferably obtained theoretically and experimentally. Conventional models such as Carvalho's analysis shows a turning point and an operability window resulting from inertial forces at Property numbers, P, defined as the Reynold's number divided by the Capillary number. That is, $$P=Re/Ca=\rho\sigma H_0/\mu^2 \quad \text{(I)}$$

where $\rho$ is the liquid density, $\sigma$ is the surface tension, $\mu$ is the liquid viscosity, and $H_0$ is the coating gap. Prior methods used compositions having a property number greater than 100.

It has been found that in practicing the method of the invention, a liquid composition can have a relatively low Property Number. Suitable liquid compositions for the method of the invention can have a Property Number less than about 100. Preferably, the property number of the liquid composition is less than about 5; more preferably, the property number is less than about 1.

A preferred way to determine experimental or actual values of attainable minimum wet thickness, $T_{w,min}$, using a coater set at certain line speed for a certain web (substrate) width includes: operating a coating process to form a uniform bead of liquid composition using for example, a metering pump, that feeds the liquid to the coating die, and then incrementally decreasing the flowrate (by turning down the pump) until the coating bead or sheet breaks or becomes highly unstable. The flowrate (in $m^3$/sec) at which the break occurs is then noted and used in Formula II to determine the minimum attainable wet thickness:

$$T_w=Q/[(Wc)(Vw)] \quad \text{(II)}$$

where Wc is the coated width (in meters, m), Vw is the substrate speed (in meters per second) and Q is the flowrate at which the bead becomes non-uniform or breaks. For a more conservative approach, the minimum attainable wet thickness can be noted that corresponds to the flowrate at which a coating failure occurs, such as complete bead failure, edge failure, combination of edge failure leading to bead failure, or narrowing of the coated width. Alternatively, in determining $T_{w,min}$ the coating wet thickness can be directly measured using measurement techniques and tools such as a beta gauge, optical equipment, or other known investigative tools that can physically determine coating thicknesses.

The concentration or level of solids within the liquid composition can affect the coatability of a liquid. It has been found that operating a coating process within parameters defined by minimum attainable wet coating thickness as a function of the percent solids of a composition provides optimal coating process performance for achieving thin coatings. Thus, the coating composition preferably has a measurable percent solids, whereby at least one polymeric component contributes to at least a portion of the percent solids. Other sources of solids can come from additives, fillers, pigments, and the like.

Correlating the percent solids with the calculated thickness achieved based on the target dry coating weight is preferably performed by plotting the actual values of the thickness against the percent solids level. For purposes of providing an accurate graphical representation of a coating thickness ($T_{w,min}$) versus percent solids curve, it is preferred that more than one value of wet minimum thickness is determined. Therefore, a coating operation is preferably run at varying levels of percent solids of the liquid composition, and the minimum attainable wet thickness is obtained for each of the percent solids level.

Figure 2:
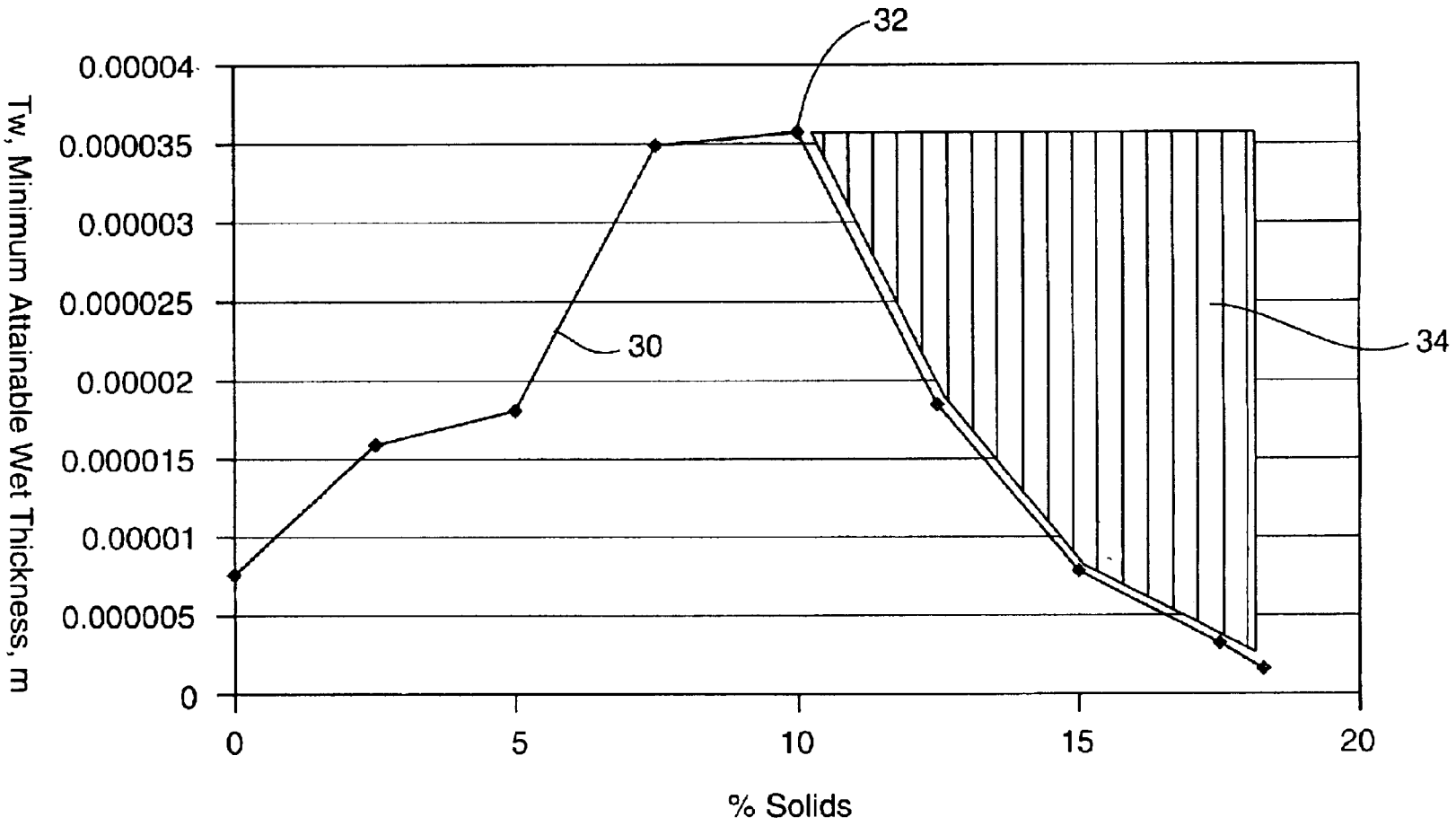
FIG. 2 is a graphical representation of a window of operability according to the invention as depicted by data from Example 1.

The graphical curve of minimum attainable coating thickness ($T_{w,min}$) versus percent solids, for convenience, is hereinafter called a "$T_{w,min}$ curve." The $T_{w,min}$ curve can be useful in understanding how a liquid composition can behave under different processing circumstances. For optimal efficiency, the method of the invention comprises identification of an operating window using the graphical representation of the $T_{w,min}$ curve. It has been found that the operating window can be identified by observing an unexpected maximum $T_{w,min}$ value, called the $T_{w,critical}$, on the $T_{w,min}$ curve. The window of operability is then identified as the area defined by the boundaries: percent solids greater than the point at which critical thickness, $T_{w,min\text{-}critical}$, occurs and minimum attainable thickness, $T_{w,min}$, greater than all points above the $T_{w,min}$ curve and equal to or less than the constant critical thickness, $T_{w,min\text{-}critical}$. A window of operability is illustrated in FIG. 2 and indicated as Reference area 34.

In an embodiment of the invention, optimization of a coating process can also be performed using a preferred method of the invention that comprises a step of initially defining a target dry coating weight, which can then be correlated to a desired coating thickness. A target dry coating weight can be chosen based on product specifications and is generally provided in (kg/$m^2$). Depending on the character of desired coating, parameters such as, for example, substrate (line) speed, coating gap, die geometry, and applied vacuum, can be varied to achieve a certain coating weight or thickness.

Alternatively, a target dry coating thickness can be defined to initiate and set up the coating process. A dry coating thickness is directly related to a dry coating weight by the density of the dry coating. That is, the dry coating thickness can be determined by dividing the target dry coating weight (weight per unit area) by the density of the solid composition (weight per unit volume). Of the two product specifications to define, it is preferred that the target be defined in terms of dry coating weight (kg/$m^2$) because known densities of a dry coating may be limited.

The target dry coating weight can then be used to obtain theoretical values of wet thickness to provide a theoretical curve representing calculated wet thickness values ($T_{w,calc}$) as a function of percent solids, at a target dry coating weight, using Formula (II):

$$T_{w,calc}=(100*W_D)/(\%S*\rho_L) \quad \text{(I)}$$

wherein $W_D$ is the dry coating weight, %S is the percent solids, and $\rho$ is the coating liquid density. By plotting the calculated values of $T_w$ against the percent solids, a modified window of operability can be determined by comparing the theoretical model ($T_{w,calc}$ curve) against the $T_{w,min}$ curve. In particular, the modified operability window is defined by the boundaries of values of $T_{w,calc}$ greater than all points above the theoretical curve and a percent solids level greater than the point at which the $T_{w,min\ critical}$ occurs.

Upon determining an operability window, a practitioner may choose to further optimize a coating operation to achieve coatings at a specific target wet thickness, yet stay within the window of operability. This can be accomplished by a variety of methods, including for example, increasing percent solids of the polymer-containing liquid composition, adding gel-breaking additives, increasing the molecular weight of the polymer, adding another polymer into the solution, increasing the polymer to other solids ratio, increasing the substrate speed to achieve a lower $T_{w,min}$, and combinations thereof.

Compositions suitable for the coating methods of the invention are those that are substantially free of crosslinking and gellation. For purposes of the present invention, gellation is used to indicate both physical and chemical gellation. Although is it preferred that gellation be preferably absent in the composition, a certain level can be tolerated. Particularly preferred coating compositions have a certain level of extensional viscosity. That is, when a small stick is placed in a container of a liquid composition and then slowly removed, a "bead" or "string" can be observed leading from the stick to the main portion of the liquid.

Compositions suitable in the practice of the invention include, for example, those that preferably contain substantially linear polymeric components. More preferably, polymers are substantially free of cross-linking and gellation. In particular, longer chains of polymers are preferred. Examples of preferred polymers include polyvinyl butyral, polyvinyl formal resins, ketone soluble polyester, cellulose acetate butyrate, polyvinyl alcohol, polyethylene oxide, and combinations thereof.

The molecular weight of the polymeric component is preferably sufficient to exhibit the desired coatability effects of this invention. Polymers having a molecular weight greater than about 25,000 g/mole and less than about 1,000,000 g/mole are preferred. More preferably, the molecular weight is greater than about 40,000 g/mol and less than 250,000 g/mol.

The concentration of the non-crosslinked and non-gelatinous polymer can be present in the liquid coating composition at about 0.1 to about 50 percent. Preferably, the polymer is present in a concentration greater than about 0.2%; more preferably the polymer concentration is greater than about 1.0%.

The average molecular weight can be increased by a variety of ways including for example, adding or substituting for the same polymer, but with a high molecular weight.

A further component present in the liquid composition used in the extrusion operations of the invention is a diluent. Suitable diluents are compounds that can help make the polymeric component of the liquid composition flowable for purposes of slot extrusion. Preferred diluents include, but are not limited to, water, UV-curable monomers such as isobornyl acrylate, hexanediol diacrylate, and low-molecular weight solvents such as methylethyl ketone, heptane, cyclohexane, methyl alcohol, ethyl alcohol, propanol, 1,1,2-trichloroethane, methylene chloride, toluene and acetone. The diluent may be toluene, acetone, water, methyl ethyl ketone, or combinations thereof. The diluent is preferably present in the liquid composition in a sufficient amount to provide a coatable composition that when dried or cured forms a thin coating.

Optionally, additional components can be added in sufficient amounts to the liquid composition to achieve a desired effect without adversely impacting the coating composition. For example, additives such as fillers, rheology modifiers, dispersants, wetting agents, slip agents, defoamers, plasticizers, pigments, extenders, corrosion inhibitors, can be included if desired.

A coated substrate obtained from using the method of the invention preferably forms a coating having a wet coating thickness less than about 0.0381 mm (1.5 mil). More preferably, the liquid composition, upon application to a substrate, has a wet coating thickness less than about 0.0254 mm (1 mil).

In view of the present teaching those skilled in the art will appreciate the manner in which various parameters can be modified within the scope of the present invention. Such parameters include the relative and final diluent and polymer concentrations, the polymer molecular weight, polymer type and formulation pH.

In preferred methods of the invention, the extrusion operation is performed at room temperature. In particular, the temperature of the liquid composition itself is preferably maintained at room temperature. Those skilled in the art are capable of selecting operating temperatures based on specific coating compounds, coating equipment and desired coating results.

A number of embodiments of the invention have been described. Nevertheless, it will be understood that various modifications may be made without departing from the spirit and scope of the invention.

EXAMPLES

Example 1

Compositions with the following concentration of a dry silver color magenta solution were prepared: 0, 2.5, 5, 7.57, 10, 12.5, 15, 17.5, and 18.3% solids, using solids consisting primarily of BUTVAR-76 (Monsanto; St. Louis, Mo.) and silver behenate half soap in the ratio of 100 to 18.6 by weight. Butvar B76 has a weight average molecular weight of 90,000 to 120,000 g/mol. The dry silver was mixed in a binary solvent system of toluene (87.6%) and acetone (13.4%).

The solutions were coated onto 0.05082 mm (2 mil) thick polyester film substrate. The coating operation was performed using a 101.6 mm (4 inch) wide slot extrusion coating bar as described in WO 95/29764. The configuration of the coating apparatus was held constant at the following conditions: 0.0762 mm (3 mil) overbite, 0.127 mm (5 mil) convergence, 0.178 mm (7 mil) slot height, 0.229 mm (9 mil) coating gap, and a 0.152 mm (6 mil) vacuum box gap. Other variables in the study, besides solution concentration were substrate speed (0.508 m/sec (100 ft/min) and 2.54 m/sec (500 ft/min)) and vacuum level, where the vacuum level was adjusted between (0.5 to about 8 in. of water column) 124 Pa to about 1991 Pa to suit the coating conditions. A good (acceptable) coating sheet was established using a combination of substrate speed, coating gap, vacuum, and flow rate. The minimum wet coating thickness was then determined by reducing the flow rate until one of the following occurred: complete bead failure, edge failure, combination of edge failure leading to bead failure, or significant narrowing of the coating width—i.e. a coating instability. The flow rate at which the failure occurred was recorded and the minimum attainable wet thickness, $T_{w,min}$ was then calculated from the noted flow rate. This procedure was repeated for each of the percent solids levels to obtain multiple values of minimum attainable wet thickness.

The values of "minimum attainable wet thickness, $T_w$" were plotted as a function of percent solids as illustrated in FIG. 2. It was observed that initially, $T_w$ increases as the percent solids increases; but surprisingly, the $T_w$ curve 30 did not continue increasing with percent solids, but rather, $T_w$ reaches a maximum, identified as $T_{w,critical}$ 32. The curve then sloped downward, indicating that minimum attainable wet thickness decreased at even higher percent solids, to a low $T_w$ of about less than 0.00254 mm (0.1 mil). Area 34 indicates a window of operability, according to the present invention.

Figure 3:
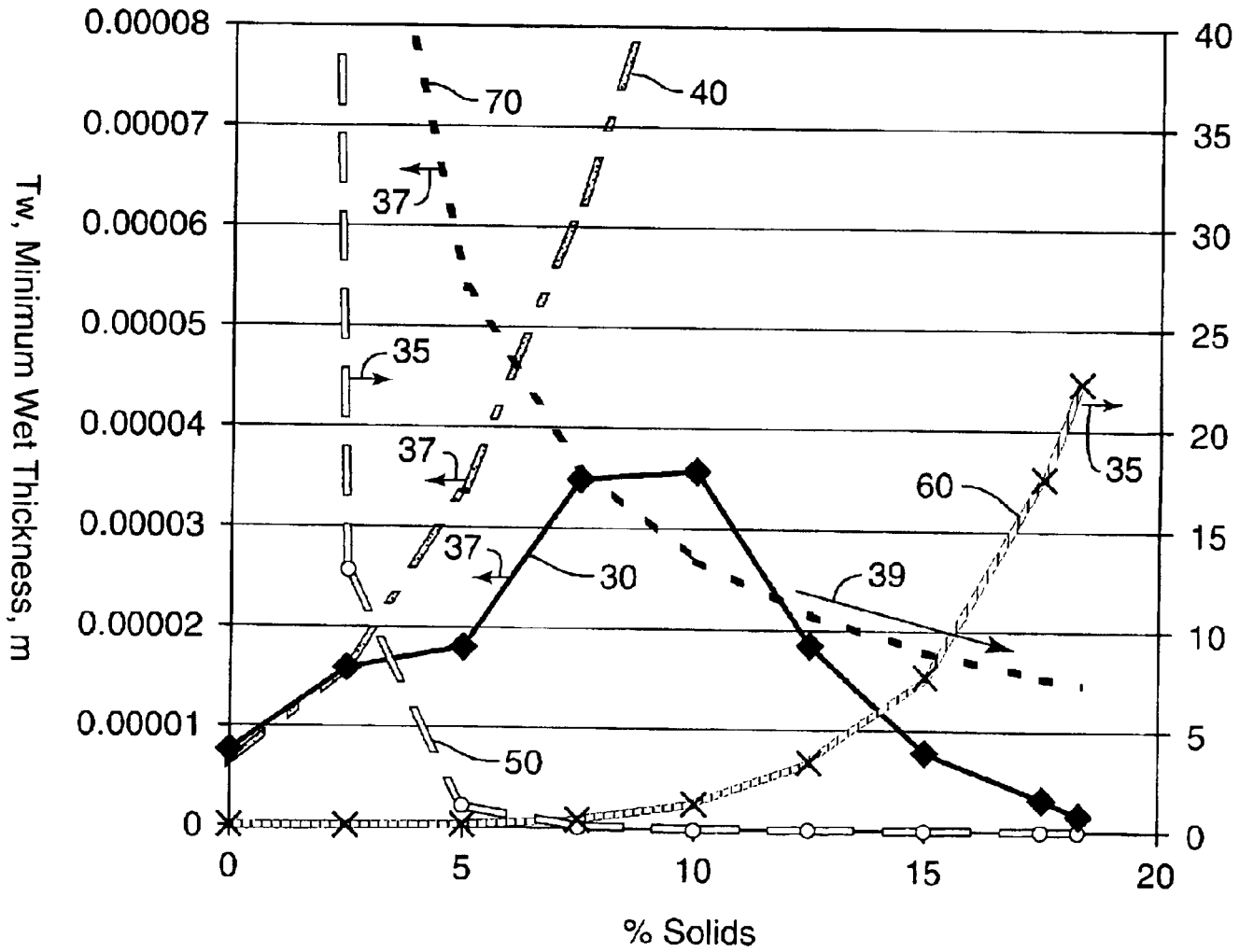
FIG. 3. is a graphical representation of experimental and theoretical data from Example 1.

FIG. 3, provides a viscocapillary (e.g., theoretical) model 40 overlayed onto the same curve 30 shown in FIG. 2. Arrows 35 and 37 indicate the direction pointing to the appropriate vertical axis for the corresponding curves. The theoretical model depicted in FIG. 2 makes clear that without the knowledge of the experimental data, it would not have been discovered that coating at higher percent solids could be achieved. As seen in FIG. 3, Property number, P, shown as curve 50 is vanishingly small at the Capillary number, Ca, as shown as curve 60, greater than 1. In fact, P is only large for the coating having the lowest percent solids and viscosity data—this is explained by prior viscocapillary models (those without inertial effects) such as described by Rushak, and Higgins and Scriven (Higgins, B. G. and Scriven, L. E. "Capillary pressure and viscous pressure drop set bounds on coating bead operability." Chem. Eng. Sci. 35:673–682. 1980) (Rushak, K. J. "Limiting flow in a pre-metered coating device." Chem. Eng. Sci. 31:1057–1060. 1976).

For a given product, a certain dry coating thickness is generally the required specification. In this example, the target dry coating weight, $W_D$, was 0.00269 Kg/m$^2$ (250 mg/ft$^2$). A coating window exists where the values of $T_{w,calc}$ as shown as curve 70 are greater than the $T_{w,min}$ curve as shown as curve 30 at a percent solids greater than the occurrence of $T_{w,critical}$. In comparison, using the Viscocapillary model, one would not have expected to make the product at a percent solids greater than about 6%. Thus, experimental data is useful in identifying an operability window—product can be coated at any percent solids less than about 7.5%. Furthermore, there is an operability window, indicated by arrow 39, beyond 12.5% solids that would not have been identified by conventional theoretical models.

Figure 4:
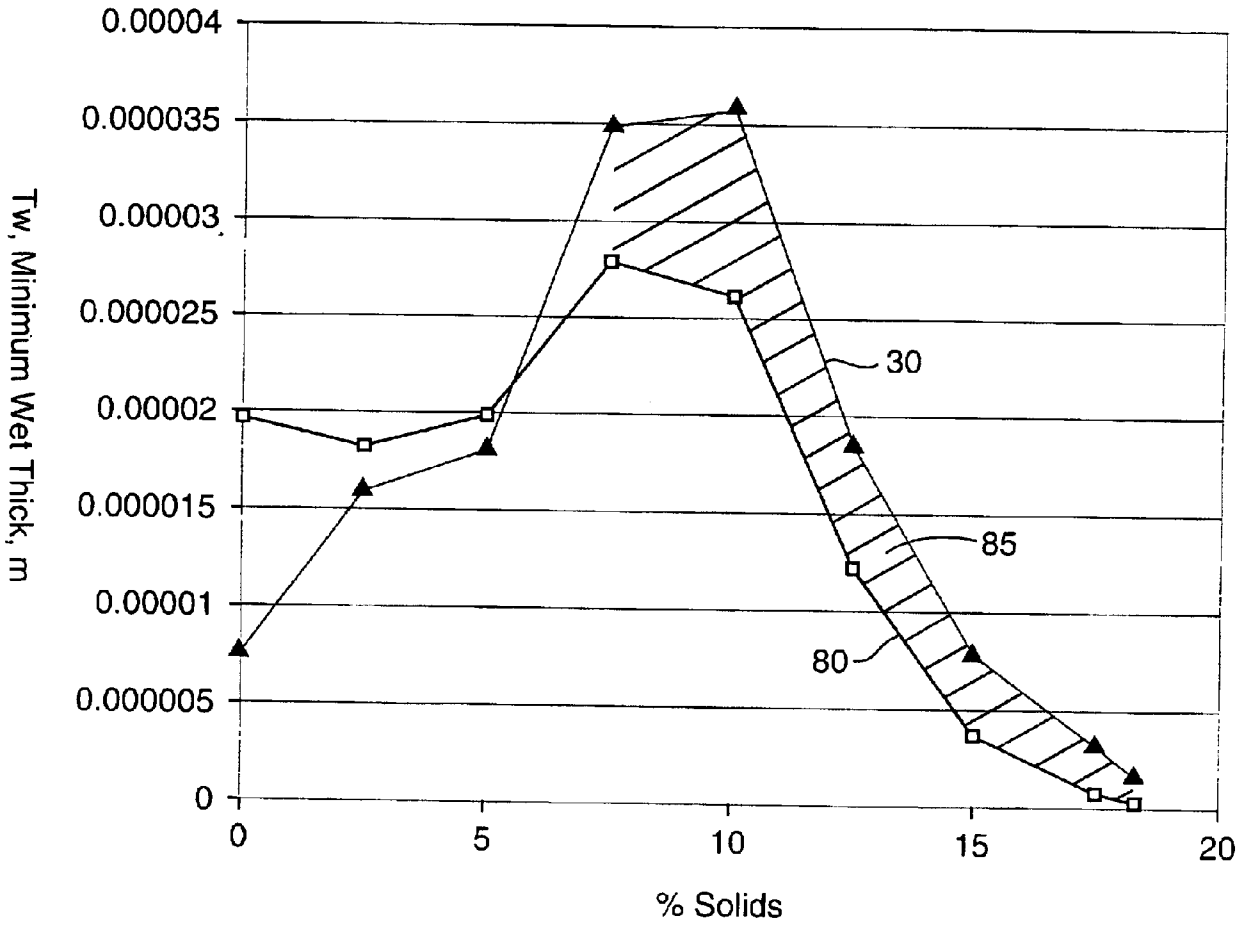
FIG. 4 is a graphical representation of data from Example 1 at various substrate speeds.

FIG. 4 shows that the $T_w$ curved obtained at the two different substrate speeds: 0.508 m/sec (100 ft/min) and 2.54 m/sec (500 ft/min). Curve 80 represents the data obtained at a substrate speed of 2.54 m/sec (500 ft/min), while curve 30 represents the data obtained at a substrate speed of 0.508 m/sec (100 ft/min). It was found that a coating window of this invention surprisingly improves with an increase in substrate speed. As seen in the figure, curve 80 (2.54 m/sec (500 ft/min) substrate speed) improves the window of operability by adding the area 85. Furthermore, it was observed that $T_{w,critical}$ decreased as substrate speed increased. The level of the $T_{w,min}$ curve decreased in the range where percent solids was greater than the value at which $T_{w,critical}$ occurs. Thus, both of these factors seemed to positively affect (increase) the window of coating for thinner wet layers.

Example 2

Liquid compositions having various concentrations of solids were prepared for printing plate construction. The coating composition was similar to that disclosed in Example 8 of EP 462,704 A1, herein incorporated by reference in its entirety. The percent solids levels were: 5, 7, 9, 11, 13, 20, 21, 26% solids. The solids consisted primarily of a ketone soluble polyester (KSPE) and a diazo analog (KSPD). The KSPE has a weight average molecular weight of 31,800–37,000 g/mol. The coating liquid was mixed in a solvent system of methyl ethyl ketone.

The solutions were coated onto 0.0508 mm (2 mil) thick polyester film substrate. The coating operation was performed using a 101.6 mm (4 inch) wide slot extrusion coating bar as described in WO95/29764. The configuration of the coating apparatus was held constant at the following conditions: 0.0762 mm (3 mil) overbite, 0.127 mm (5 mil) convergence, 0.178 mm (7 mil) slot height, 0.152 mm (6 mil) coating gap and a 0.152 mm (6 mil) vacuum box gap. The variables in the study, besides solution concentration were substrate speed (0.508, 1.524 m/sec (100 ft/min, 300 ft/min)) and vacuum level (124 Pa, 560 Pa, and 995 Pa (0.5, 2.25, and 4 inches water column)). A good (acceptable) coating sheet was established using a combination of substrate speed, coating gap, vacuum, and flow rate. The minimum wet coating thickness was then determined by reducing the flow rate until one of the following occurred: complete bead failure, edge failure, combination of edge failure leading to bead failure, or significant narrowing of the coating width—i.e. a coating instability. The flow rate at which the failure occurred was recorded and the minimum attainable wet thickness, $T_{w,min}$ was then calculated from the noted flow rate. This procedure was repeated for each of the percent solids levels to obtain multiple values of minimum attainable wet thickness.

Figure 5:
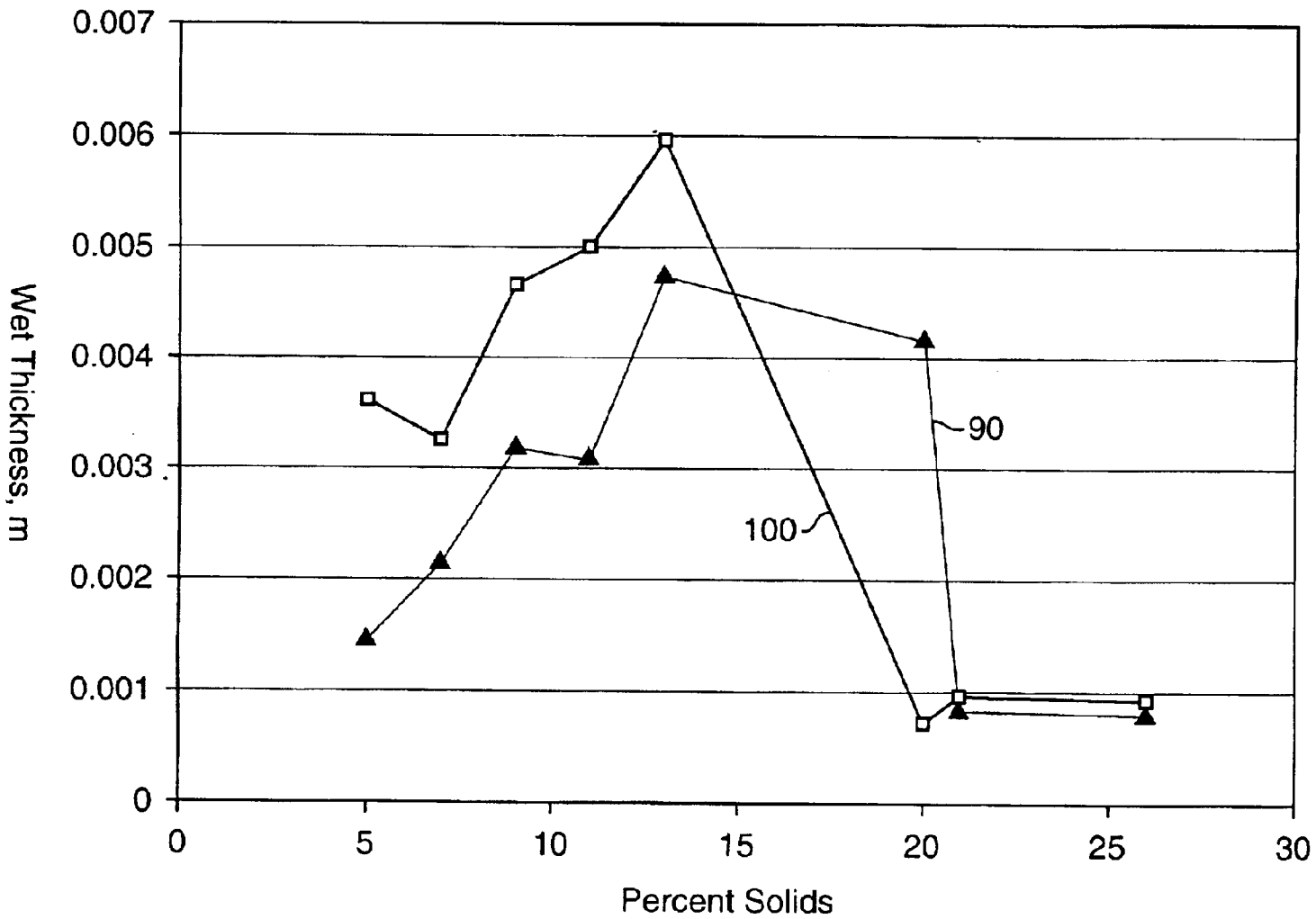
FIG. 5 is a graphical representation of data from Example 2.

It was observed that the coating solution tended to gel when the percent solids level was 15% solids or greater (with the MEK solvent only). This gellation caused the solution to be uncoatable. Although these liquids had a higher viscosity that would be coincident with the higher solids, they did not coat or demonstrate a $T_{w,critical}$ maximum in the $T_{w,min}$ curve. To prevent gellation, 2% water was added to the coating liquid, for all solutions having more than 7% solids. The results of the coatings after eliminating gellation are shown in FIG. 5. Curve 90 represents data obtained from running the process at a substrate speed of 0.508 m/sec (100 ft/min), while curve 100 represents data from running substrate speed of 1.54 m/sec (300 ft/min). As seen in FIG. 5, the desired $T_{w,critical}$ maximum in the $T_{w,min}$ curve was achieved. In addition, $T_{w,critical}$ was at a lower percent solids when substrate speed was higher—1.54 m/s (300 fpm), compared to that at a lower substrate speed of (0.508 in/sec) (100 fpm).

Example 3

Liquid compositions having various concentrations of percent solids were prepared for a proofing product construction in a manner similar to the coating solution described in the Examples of U.S. Pat. No. 4,666,817, herein incorporated by reference in its entirety. The solids consisted primarily of a polyvinylformal resin, FORMVAR 15/95E (Monsanto; St. Louis, Mo.), and dispersed pigments. The polyvinylformal resin has a weight average molecular weight of 70,000–150,000 g/mol. The coating liquid was mixed in a solvent system of 1,1,2-trichloroethane. Coating liquids at a 60/40 Resin/Pigment ratio were prepared at 9, 10, 11, and 12% solids. Coating liquids at 70/30 Resin/Pigment ratio were prepared at 10, 12, 14, and 16% solids.

The solutions were coated onto 0.51 mm (2 mil) thick polyester film substrate. The coating operation was performed using a 101.6 mm (4 inch) wide slot extrusion coating bar as described in WO95/29764, herein incorporated by reference in its entirety. The configuration of the coating apparatus was held constant at the following conditions: 0 mm (0 mil) overbite, 0.127 mm (5 mil) convergence, 0.178 mm (7 mil) slot height, 0.102 mm (4 mil) coating gap and a 0.152 mm (6 mil) vacuum box gap. The variables in the study, besides solution concentration were vacuum level, between about 498 Pa to about 1493 Pa (between about 2 and about 6 inches water column), and substrate speed of 0.635 m/sec (125 fpm) and 1.27 m/sec (250 fpm). A good (acceptable) coating sheet was established using a combination of substrate speed, coating gap, vacuum, and flow rate. The minimum wet coating thickness was then determined by reducing the flow rate until one of the following occurred: complete bead failure, edge failure, combination of edge failure leading to bead failure, or significant narrowing of the coating width—i.e. a coating instability. The flow rate at which the failure occurred was recorded and the minimum attainable wet thickness, $T_{w,min}$ was then calculated from the noted flow rate. This procedure was repeated for each of the percent solids levels to obtain multiple values of minimum attainable wet thickness.

Figure 6:
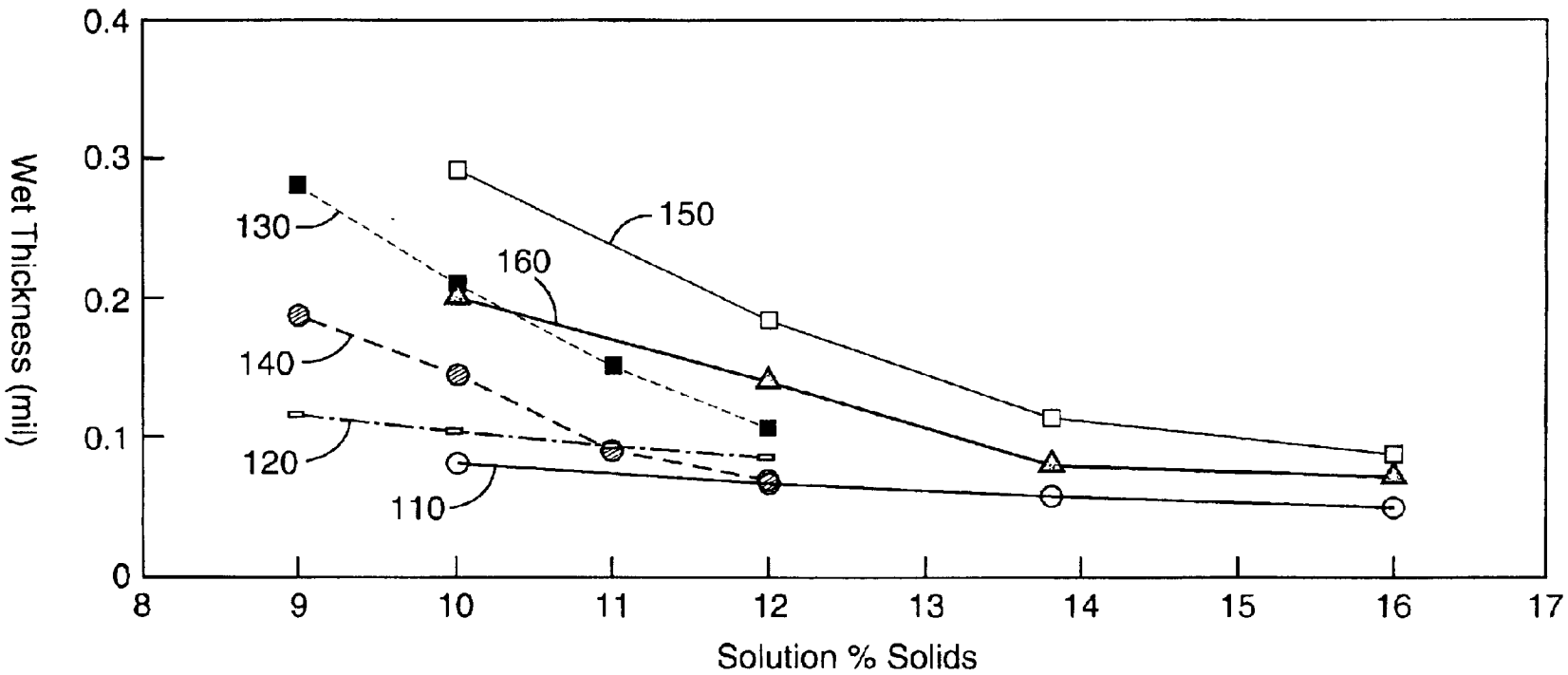
FIG. 6 is a graphical representation of data from Example 3, at various substrate speeds.

FIG. 6 presents the graphical representation of the results from this example. Curves 130 and 140 represent the data for the coating liquid having 70/30 resin/pigment ratio, at substrate speeds of 0.635 m/sec (125 ft./min) and 1.27 m/sec (250 ft./min), respectively. Curves 150 and 160 represent the data for the coating liquid having 60/40 resin/pigment ratio, at substrate speeds of 0.635 m/sec (125 ft./min.) and 1.27 m/sec (250 ft./min.), respectively. Curves 110 and 120 are the target thickness for the corresponding % solids, for the liquid composition having 60/40 and 70/30 resin/pigment ratios, respectively. The results indicated that it was difficult to attain the target coating weight of 0.000269 Kg/m$^2$ (25 mg/sq ft) with the 60/40 resin/pigment coating liquid. For the 70/30 resin/pigment coating liquid, the target coating weight was increased 0.000359 Kg/m$^2$ (33.33 mg/sq ft) to match the same color specification (e.g. optical color density) required for the product. A coating window was identified for the 70/30 resin/pigment coating liquid—the boundaries being: values of $T_{w,calc}$ greater than the $T_{w,min}$ curve at a percent solids greater than the occurrence of $T_{w,critical}$. Thus the optimum values for the process were achieved when the resin/pigment ratio was 70/30, the substrate speed was 1.27 m/sec (250 ft./min.), and the percent solids was about 12%.

It was surprisingly observed that the level of the $T_{w,min}$ curve decreased as substrate speed was increased, in the percent solids range that was greater than when $T_{w,critical}$ occurred. Thus, increased substrate speed and increased resin/pigment ratio (thus increasing the solids) were needed to attain the target coating thickness.

Figure 7:
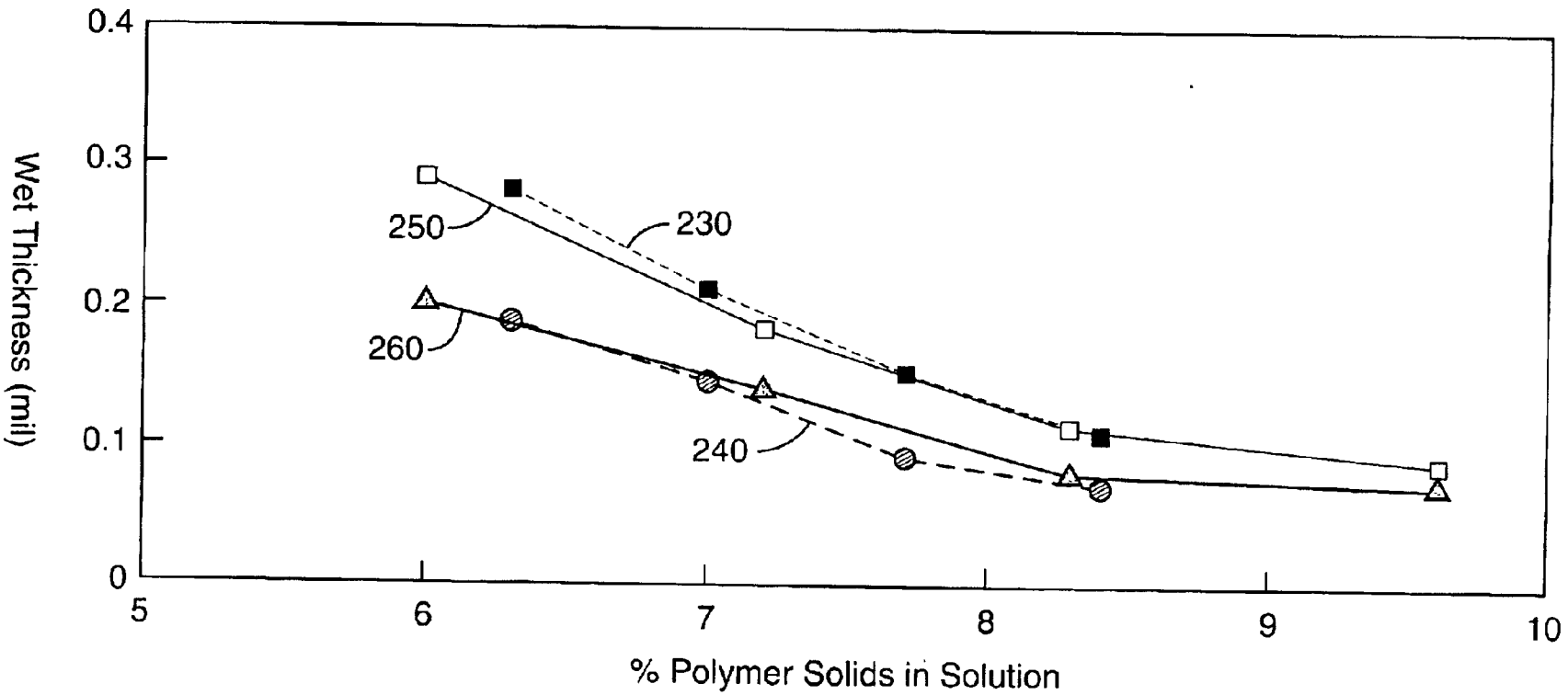
FIG. 7 is a graphical representation of data from Example 3, at varying concentration of polymer.

FIG. 7 provides the results of this example in terms of polymer concentration in the liquid composition (as opposed to percent solids). Each curve corresponds to those in FIG. 6 (target thickness curves omitted), except they are noted with reference numeral beginning with a "2." This graph shows how coating performance can be affected by the concentration of polymer in solution. As seen in the FIG. 6, the $T_{w,min}$ curves versus percent polymer in solution are nearly coincident for a given web speed.

What is claimed is:

1. A method for slot extrusion coating comprising:

providing a liquid composition including at least one polymer and a diluent, said composition being substantially free of crosslinking and gellation and having a measurable percent solids;

operating a slot extrusion coater wherein said liquid composition is extruded from said slot extrusion coater;

determining actual values of minimum wet thickness, $T_{w,min}$ at a plurality of percent solids levels;

obtaining a first graphical curve representing actual values of wet thickness, $T_{w,min}$ as a function of percent solids level;

identifying the critical wet thickness, $T_{w,min\text{-}critical}$ on the first graphical curve; and identifying a window of operability as an area defined by the boundaries: percent solids greater than the point at which critical wet thickness, $T_{w,min\text{-}critical}$ occurs; and an actual wet thickness greater than all points above the first graphical curve and equal to or less than the critical thickness, $T_{w,min\text{-}critical}$.

2. The method according to claim 1 further comprising the steps of:

defining a target dry coating weight, $W_D$;

calculating a plurality of values for $T_{w,calc}$ (meters) using formula (I), each $T_{w,calc}$ value corresponding to a percent solids level, wherein formula (I) is $$T_{w,calc}=(100*W_D)/(\%S*\rho_L) \quad \text{(I)}$$

wherein $W_D$ is the dry coating weight (kg/m$^2$), %S is the percent solids, and ρ is coating liquid density (kg/m$^3$);

obtaining a second graphical curve representing calculated values of wet thickness, $T_{w,calc}$ as a function of percent solids level; and identifying the window of operability as the area defined by the boundaries: $T_{w,calc}$ greater than the first graphical curve and a percent solids level greater than the point at which $T_{w,min\text{-}critical}$ occurs.

3. The method according to claim 1 further comprising:

adjusting said liquid composition to have a percent solids within said window of operability; and coating a substrate with said liquid composition at a minimum wet thickness $T_w$ that falls within said window of operability.

4. The method according to claim 1 wherein said substrate speed is less than about 10 m/sec.

5. The method according to claim 1 wherein said substrate speed is greater than about 0.127 m/sec.

6. The method according to claim 1 wherein said liquid composition comprises at least one polymer having a molecular weight average less than about 1,000,000 g/mol.

7. The method according to claim 1 wherein said liquid composition comprises at least one polymer having a molecular weight average less than about 250,000 g/mol.

8. The method according to claim 1 wherein said liquid composition comprises at least one polymer having a molecular weight average greater than about 25,000 g/mol.

9. The method according to claim 1 wherein said liquid composition includes at least 0.2% by weight of a polymeric composition.

10. The method according to claim 1 wherein said liquid composition includes at least 1% by weight of a polymeric composition.

11. The method according to claim 1 further comprising:

adding gel-breaking additives to said composition.

12. The method according to claim 1 further comprising:

increasing the average molecular weight of said at least one polymer.

13. The method according to claim 1 further comprising:

adding a second polymer to said liquid composition.

14. The method according to claim 1 wherein said coating operation comprises a process variable corresponding to a coating gap between a die and a roller, and said liquid composition has a property number less than about 100.

15. The method according to claim 1 further comprising increasing the substrate speed; and obtaining an additional graphical curve representing minimum wet thickness measurement as a function of percent solids.

16. The method according to claim 1, wherein said at least one polymer is polyvinyl butyral, polyvinyl formal resins, ketone soluble polyesters, cellulose acetate butyrate, polyvinyl alcohol, polyethylene oxide, or combinations thereof.

17. The method according to claim 1 wherein said diluent comprises at least one of toluene, acetone, water, methyl ethyl ketone, or combinations thereof.

* * * * *

UNITED STATES PATENT AND TRADEMARK OFFICE

CERTIFICATE OF CORRECTION

PATENT NO. : 6,720,025 B2
DATED : April 13, 2004
INVENTOR(S) : Yapel, Robert A.

It is certified that error appears in the above-identified patent and that said Letters Patent is hereby corrected as shown below:

Column 1,
Line 50, delete “Theological”, insert in place thereof -- rheological --;

Column 10,
Line 50, delete “(0.508 in/sec)”, insert in place thereof -- (0.508 m/sec) --.

Signed and Sealed this

Thirtieth Day of November, 2004

JON W. DUDAS
*Director of the United States Patent and Trademark Office*